US007600837B2

(12) United States Patent
Sekiguchi

(10) Patent No.: US 7,600,837 B2
(45) Date of Patent: Oct. 13, 2009

(54) DROPLET EJECTION APPARATUS

(75) Inventor: Yasuhiro Sekiguchi, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 332 days.

(21) Appl. No.: 11/656,838

(22) Filed: Jan. 23, 2007

(65) Prior Publication Data

US 2007/0176952 A1 Aug. 2, 2007

(30) Foreign Application Priority Data

Jan. 27, 2006 (JP) ..... 2006-018516

(51) Int. Cl.
*B41J 29/38* (2006.01)

(52) U.S. Cl. ..... 347/10; 347/11; 347/30

(58) Field of Classification Search ..... 347/5, 347/9, 10–12, 15, 30, 35
See application file for complete search history.

(56) References Cited

U.S. PATENT DOCUMENTS

| | | | |
|---|---|---|---|
| 5,541,628 | A | 7/1996 | Chang et al. |
| 6,174,038 | B1 | 1/2001 | Nakazawa et al. |
| 6,663,208 | B2 | 12/2003 | Suzuki et al. |
| 6,955,418 | B2 | 10/2005 | Ito |
| 2001/0007640 | A1 | 7/2001 | Fujii et al. |
| 2004/0135832 | A1 | 7/2004 | Usuda |
| 2004/0145622 | A1 | 7/2004 | Suzuki |

FOREIGN PATENT DOCUMENTS

| | | |
|---|---|---|
| EP | 0 788 882 | 8/2007 |
| JP | 9-295411 | 11/1997 |
| JP | 2002-160362 | 6/2002 |
| JP | 3480494 | 10/2003 |
| JP | 2004-25636 | 1/2004 |

*Primary Examiner*—Lamson D Nguyen
(74) *Attorney, Agent, or Firm*—Reed Smith LLP

(57) ABSTRACT

A droplet ejection apparatus comprises: (a) a recording head including a nozzle from which a droplet of a liquid is ejected, (b) a pressure chamber which is filled with the liquid and whose volume is changeable for ejecting the droplet from the nozzle, and (c) an actuator which changes the volume of the pressure chamber by a drive pulse inputted thereto; and an operating device which outputs the drive pulse to the actuator and which is capable of performing a restoring operation for restoring a droplet ejection performance of the recording head. The restoring operation includes: a first operation for outputting, a plurality of times, an ejection drive pulse as the drive pulse by which the droplet can be ejected; and a second operation for outputting, a plurality of times, a non-ejection drive pulse as the drive pulse by which the droplet can not be ejected, the second operation being performed following the first operation.

14 Claims, 6 Drawing Sheets

FIG.6

| | | Tp | | | | |
|---|---|---|---|---|---|---|
| | | 0.13 AL | 0.18 AL | 0.22 AL | 0.27 AL | 0.31 AL |
| Tw | 0.11 AL | ○ | △ | × | × | × |
| | 0.22 AL | ○ | ○ | ▲ | × | × |
| | 0.33 AL | ○ | ○ | ▲ | × | × |
| | 0.44 AL | ○ | ○ | ○ | ○ | ○ |
| | 0.89 AL | ○ | ○ | ○ | ○ | ○ |
| | 1.33 AL | ○ | ○ | ○ | ○ | △ |
| | 1.78 AL | ○ | ○ | △ | ▲ | ▲ |
| | 2.22 AL | ○ | ◎ | △ | ▲ | ▲ |
| | 2.67 AL | ○ | ◎ | ◎ | ○ | △ |
| | 3.11 AL | ○ | ◎ | ○ | ○ | △ |
| | 3.56 AL | ○ | ○ | ○ | △ | ▲ |
| | 4.00 AL | ○ | ○ | ○ | ▲ | ▲ |
| | 4.44 AL | ○ | ○ | ○ | ○ | ▲ |

◎ OPTIMUM CONDITION
○ NO EJECTION
△ EJECTION AT NOT LESS THAN 34℃
▲ EJECTION AT NOT LESS THAN 24℃
× EJECTION

DROPLET EJECTION APPARATUS

The present application is based on Japanese Patent Application No. 2006-018516 filed on Jan. 27, 2006, the contents of which are incorporated herein by reference.

BACKGROUND OF THE INVENTION

1. Field of the Invention

The present invention relates to a droplet ejection apparatus, such as an inkjet printer, capable of ejecting droplets of a liquid such as ink, and more particular to an operation of the droplet ejection apparatus for preventing a poor droplet ejection performance due to drying of the liquid contained inside of a nozzle.

2. Discussion of Related Art

There has conventionally been known an inkjet printer including a recording head which is mounted on a carriage and which has a plurality of nozzles provided on a lower surface thereof. In the conventional inkjet printer, while the recording head is reciprocated in a recording area, a recording operation in which droplets of ink are ejected onto a recording medium is performed so as to record an image thereon. In the recording operation, drive pulses are inputted into a piezoelectric actuator such that volumes of pressure chambers which are filled with the cink are changed. Thus, the ink droplets are ejected from the plurality of nozzles of the recording head toward an upper surface of the recording medium.

In the conventional inkjet printer which employs the recording head having the plurality of nozzles through which the ink droplets are ejected, a solvent of the ink, e.g., water, is gradually dried up in the nozzles due to an intermission of the recording operation or few opportunities of ink-droplet ejections, and thus, the ink becomes thickened in the nozzles. Consequently, the ink droplets which are ejected from the nozzles tend to be decreased in size, or an ink-droplet ejection performance of the recording head tends to be deteriorated. This state causes a deterioration in a recording performance of the recording head.

In order to avoid the above-described deterioration in the recording performance, a preparatory ink-droplet ejection, i.e., so-called "a flushing operation", is performed before a recording process or in the middle of a recording process. In the flushing operation, the recording head is moved regularly or forcibly to a flushing position where a droplet receiver is disposed such that a lower surface of the recording head faces an upper surface of the droplet receiver. More specifically, the droplet receiver is disposed outside of the recording area, i.e., a non-recording area. After the recording head is moved to the flushing position as a specific position in the non-recording area, the drive pulses are inputted to the actuator such that the ink which remains in the nozzles is forcibly ejected. Thus, the flushing operation is effective to restore the ink-droplet ejection performance of the recording head.

However, the flushing operation may cause an increase in a time required for the recording process and a waste of the ink since the recording operation is inevitably interrupted in order to move the recording head to the flushing position in the non-recording area.

Therefore, as disclosed in JP-A-9-295411 (paragraph [0003] and FIG. 3, in particular) for instance, there has been proposed a droplet ejection apparatus which has first voltage applying means for applying a first voltage that is substantially identical with a head drive voltage generated in the recording operation and second voltage applying means for applying a second voltage that is lower than the first voltage in an absolute value. The disclosed droplet ejection apparatus performs, a plurality of times, a unit restoring operation for restoring the ink-droplet ejection performance of the recording head before the recording operation is performed so as to perform the flushing operation. A procedure of the unit restoring operation includes: (i) an initial step for operating the second voltage applying means a plurality of times at the substantially same period as, or shorter period than, a drive period at which the recording operation is performed; and (ii) a subsequent step for operating the first voltage applying means following the initial step.

SUMMARY OF THE INVENTION

However, in the droplet ejection apparatus disclosed in the above-indicated patent document, after the flushing operation, the ink contained in the plurality of nozzles and the pressure chambers is in a vibration state due to the unit restoring operation in which the first voltage is applied by the first voltage applying means after the second voltage is applied by the second voltage applying means. In this state, the vibration of the ink does not easily settle down. Thus, it is difficult to shorten a total time for carrying out the recording process since it takes much time for the vibrated ink to settle down after the flushing operation.

It is therefore an object of the invention to provide a droplet ejection apparatus capable of performing a restoring operation such as a preparatory ink-droplet ejection, i.e., so-called "the flushing operation" as well as shortening a time for carrying out the recording process.

The above-indicated object of the present invention may be achieved according to a principle of the invention, which provides a droplet ejection apparatus used for a recording operation in which a droplet of a liquid is ejected on a recording medium and comprises: a recording head including (a) a nozzle from which the droplet of the liquid is ejected, (b) a pressure chamber which is filled with the liquid and whose volume is changeable for ejecting the droplet from the nozzle, and (c) an actuator which changes the volume of the pressure chamber by a drive pulse inputted thereto; and an operating device which outputs the drive pulse to the actuator. The operating device is capable of performing a restoring operation for restoring a droplet ejection performance of the recording head, the restoring operation including: a first operation for outputting, a plurality of times, an ejection drive pulse as the drive pulse by which the droplet can be ejected; and a second operation for outputting, a plurality of times, a non-ejection drive pulse as the drive pulse by which the droplet can not be ejected, the second operation being performed following the first operation.

In the conventional droplet ejection apparatus disclosed in JP-A-9-295411, the operation by the first voltage applying means is performed after the operation by the second voltage applying means is performed, whereby the vibration of the liquid such as ink does not easily settle down, as described hereinabove. In contrast, in the droplet ejection apparatus according to the present invention, the first operation is initially performed such that the droplets are ejected from each of the plurality of the nozzles, then the second operation is subsequently performed such that the droplet is not ejected from each of the plurality of the nozzles. Therefore, after the restoring operation for restoring the droplet ejection performance of the recording head is performed, namely, after both of the first operation and the second operation are performed in order, the vibration of the liquid settles down in a short time, whereby it is possible to shorten an interval between the flushing operation and the recording operation to be subsequently performed. In consequence, it is effective to shorten a total time for carrying out the recording process.

Moreover, since the second operation for outputting non-ejection drive pulses by which the droplet can not be ejected in the restoring operation is performed, together with the first operation for outputting ejection drive pulses by which the droplet can be ejected, it is capable of greatly reducing a consumption amount of the liquid, as compared with an another type of the restoring operation in which only the first operation is performed. That is, since the first operation and the second operation are performed in the above-described order in the restoring operation, it is possible to reduce a total number of the ejection drive pulses by which the droplets are ejected and which are to be outputted in the restoring operation, whereby it is effective to reduce the consumption amount of the liquid such as ink.

BRIEF DESCRIPTION OF THE DRAWINGS

The above and optional objects, features, and advantages of the present invention will be better understood by reading the following detailed description of a preferred embodiment of the invention when considered in conjunction with the accompanying drawings, in which:

FIG. 6 is a table showing a result of an experiment in various combinations of a width of the non-ejection drive pulse and an interval interposed between successive two of the non-ejection drive pulses in the second pulse-train.

DETAILED DESCRIPTION OF THE PREFERRED EMBODIMENT

Figure 1:
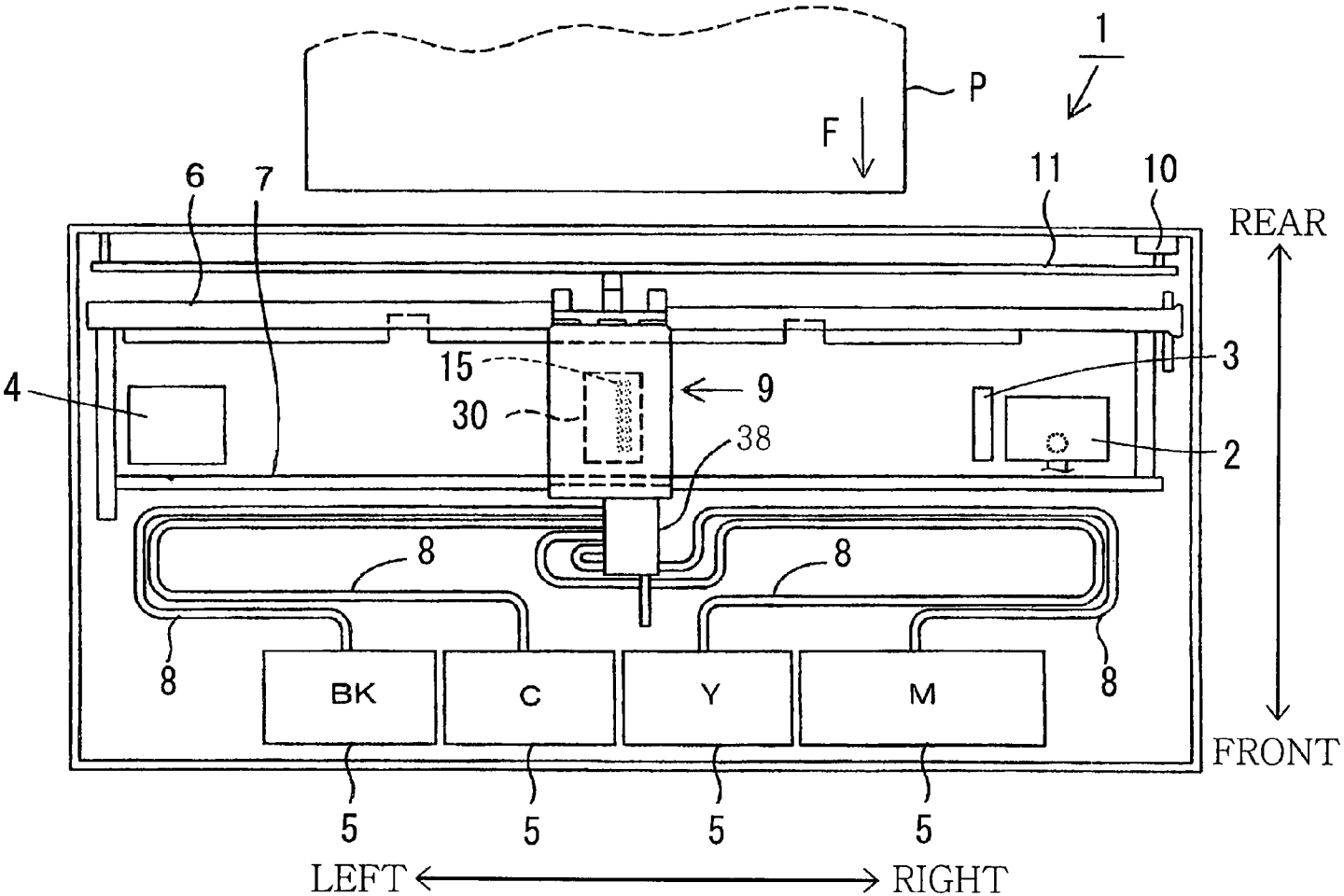
FIG. 1 is a plan view schematically showing an inkjet printer employing a droplet ejection apparatus as one embodiment of the present invention.

Hereinafter, there will be described a preferred embodiment of the present invention by reference to the drawings. FIG. 1 is a plan view of an inkjet printer 1 employing a droplet ejection apparatus as one embodiment of the present invention. In a description hereinafter, a surface of a recording head 30 in which a plurality of the nozzles 15 are formed is defined as a lower surface and a direction in which an ink is ejected from the plurality of nozzles 15 is defined as a downward direction. A direction of the recording head 30 which is opposite to the downward direction is defined as an upward direction and a surface of the recording head 30 which is opposed to the lower surface thereof is defined as an upper surface thereof. Moreover, a direction toward a leftward end of the plan view of FIG. 1 is defined as a leftward direction, a direction toward a rightward end of FIG. 1 is defined as a rightward direction. A lower end and an upper end of FIG. 1 are defined as a front side and a rear side, respectively.

As shown in FIG. 1, in the inkjet printer 1, there are provided two guide rods 6, 7 which are parallel to each other. A head holder 9 which functions as a carriage is disposed over the two guide rods 6, 7, such that the head holder 9 is slidably supported by the two guide rods 6, 7. The head holder 9 holds the recording head 30 having the plurality of nozzles 15 through which ink droplets are ejected onto an upper surface of a recording sheet P as a recording medium, so as to record an image thereon. Further, an ink tank 38 accommodating inks of mutually different colors is mounted on the head holder 9.

An endless belt 11 to which the head holder 9 is fixed is driven to turn by a motor 10, whereby the head holder 9 is reciprocated along the two guide rods 6, 7 in the leftward and rightward direction, i.e., in a widthwise direction of the recording sheet P. Meanwhile, the recording sheet P is fed toward the front side (i.e., a direction indicated by an arrow F in FIG. 1) by a feed device, not shown, which is disposed inside of the inkjet printer 1. While the recording head 30 is moved along the recording sheet P in the widthwise direction (i.e., in the leftward and rightward direction), drive pulses for ejecting the ink are outputted to an actuator 31 (shown in FIG. 2) of the recording head 30 so as to eject the ink from the nozzles 15. Consequently, the droplets of the ink are ejected onto the recording sheet P for recording an image on the recording sheet P. Hereinafter, "the droplets of the ink" may be expressed just as "the ink".

In the inkjet printer 1, there are attached four ink cartridges 5 storing mutually different four color inks, i.e., black ink (BK), cyan ink (C), magenta ink (M), and yellow ink (Y). Each of the ink cartridges 6 is connected to the ink tank 38 via a flexible ink-supply tube 8 such that the respective four color inks are stored separately in the ink tank 38. Each of the four color inks is supplied to the corresponding nozzles 15.

Outside of a recording area where a recording operation in which the ink is ejected onto the recording sheet P is performed, namely, adjacent to opposite end zones (i.e., left-end and right-end zones) of the recording area, there are provided a pair of areas each defined as a non-recording area where the recording operation is not performed. In one of the non-recording areas adjacent to the left-end zone of the recording area, there is disposed a droplet receiver 4 having a tank in which is accommodated a porous ink absorption member such as an urethane foam for absorbing waste ink ejected from the nozzles 15 of the recording head 30. A flushing operation for restoring an ink-droplet ejection performance of the recording head 30 is performed before a recording process or in the middle of a recording process. In the flushing operation, the recording head 30 is moved regularly or forcibly to a flushing position as a specific position where the droplet receiver 4 is disposed such that a lower surface of the recording head 30 faces an upper surface of the droplet receiver 4. After the recording head 30 is moved to the flushing position in the non-recording area, the ink in the nozzles 15 is forcibly ejected, as described later.

In the other of the non-recording areas adjacent to the right-end zone of the recording area, there is disposed a suction device 2 for performing a suction-purge operation in which the ink in the nozzles 15 is sucked by a known suction pump, not shown. Like the flushing operation, the suction-purge operation is performed to restore the ink-droplet ejection performance of the recording head 30. The suction device 2 has a cap which is arranged to come into close with, and remove from, the lower surface of the recording head 30 in which the nozzles 15 are formed. The suction-purge operation is performed when the cap is in close contact with the lower surface of the recording head 30. Also, next to the suction device 2, there is disposed a wiping device 3 for wiping away, by a wiping member, the ink remaining on the lower surface of the recording head 30 after the suction-purge operation.

Figure 2:
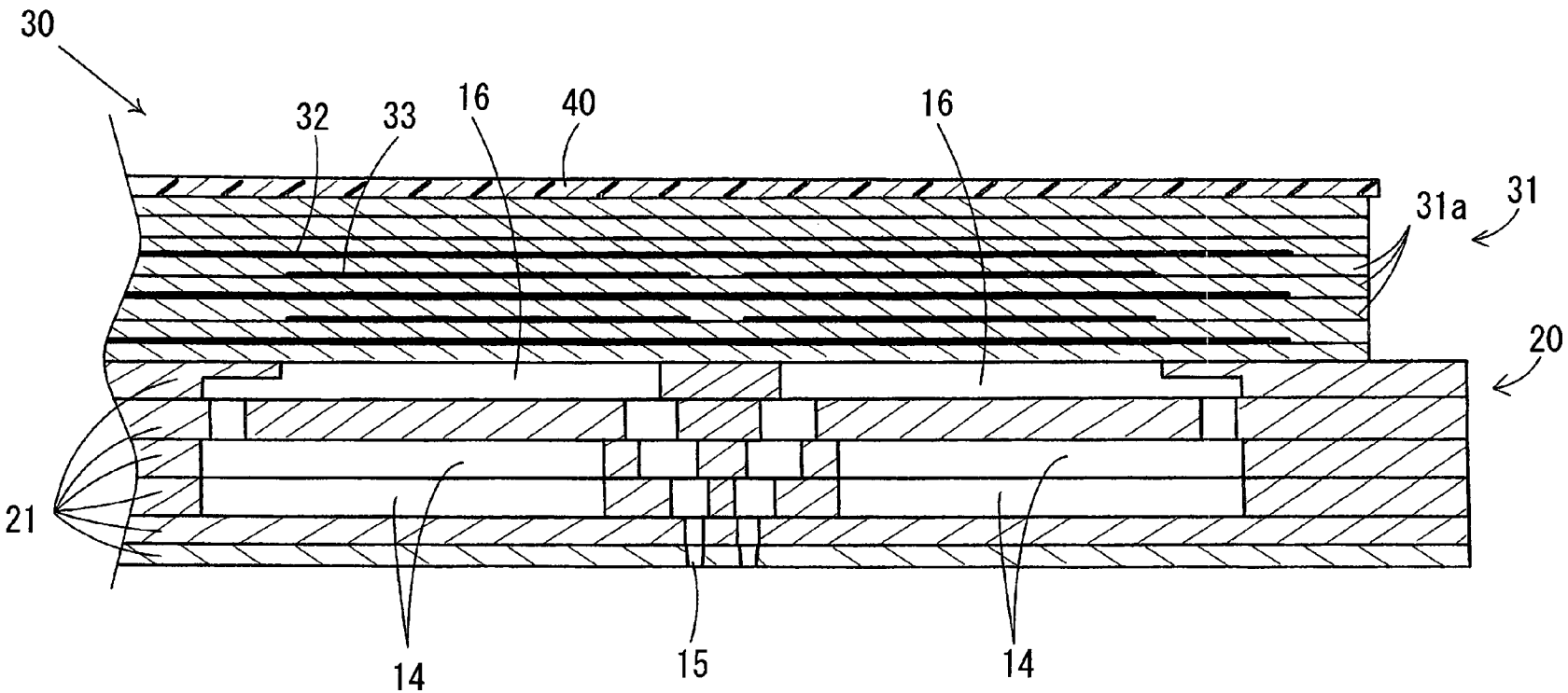
FIG. 2 is a cross-sectional view of a recording head of the inkjet printer.

The recording head 30 in the present embodiment has a structure similar to that of a known recording head disclosed in JP-A-2004-25636. As shown in FIG. 2, the actuator 31 having a plate-like shape is joined, by an adhesive, to an upper surface of a cavity unit 20. Further, a flexible wiring board 40 is electrically connected to an upper surface of the actuator 31.

The cavity unit 20 has a multilayered structure constituted by a plurality of plates 21. In a lowermost one of the plates 21, the plurality of nozzles 15 are formed in rows. On an uppermost one of the plates 21, a plurality of pressure chambers 16 are formed in rows. Each pressure chamber 16 has an elongated shape in a plan view. One of lengthwise opposite end portions of each of the pressure chambers 16 is connected to a corresponding one of the nozzles 15. while the other of the lengthwise opposite end portions of each pressure chamber 16 is connected to a corresponding one of manifolds 14 which is assigned to a corresponding one of the four color inks, i.e., (B), (C), (M), and (Y). Each of the four color inks in the ink tank 38 is supplied, via the corresponding manifold 14, to the corresponding pressure chambers 16, then supplied to the corresponding nozzles 15, and finally ejected from the corresponding nozzles 15.

The actuator 31 has a multilayered structure constituted by a plurality of piezoelectric ceramics layers 31*a*, such as PZT, each having a thickness of about 30 μm. On an upper surface of each of the piezoelectric ceramics layers 31*a* except an uppermost one of them, there are alternately disposed a plurality of common electrodes 32 and a plurality of individual electrodes 33 such that each of the common electrodes 32 and each of the individual electrodes 33 are sandwiched between any of adjacent two of the piezoelectric ceramic layers 31*a*. The common electrodes 32 are common for all of the pressure chambers 16 of the cavity unit 20 and the individual electrodes 33 correspond to the respective pressure chambers 16. The electrodes 32, 33 of the actuator 31 are electrically connected to the flexible wiring board 40 which is equipped with a drive IC chip having a built-in drive circuit 49. The drive circuit 49 generates drive pulses for applying voltage between the common electrodes 32 and the individual electrodes 33. When the voltage is applied between the common electrodes 32 and the individual electrodes 33, activate portions of the corresponding ceramics layers 31*a* interposed therebetween are deformed such that volume of the pressure chambers 16 is changed, whereby, in the recording operation, the ink is ejected from corresponding one of the nozzles 15 onto the recording sheet P so as to record the image thereon.

In the flushing operation for restoring the ink-droplet ejection performance of the recording head 30, the recording head 30 is located at the flushing position such that the lower surface of the recording head 30 faces the upper surface of the droplet receiver 4. Then, as described in detail later, the ink is ejected from all of the nozzles 15 to the droplet receiver 4 a plurality of times. Subsequently, moderate vibration is given to a meniscus of the ink which is formed in each of the nozzles 15 with no ink ejection. It is noted that the flushing operation is performed independently of the recording operation.

Figure 3:
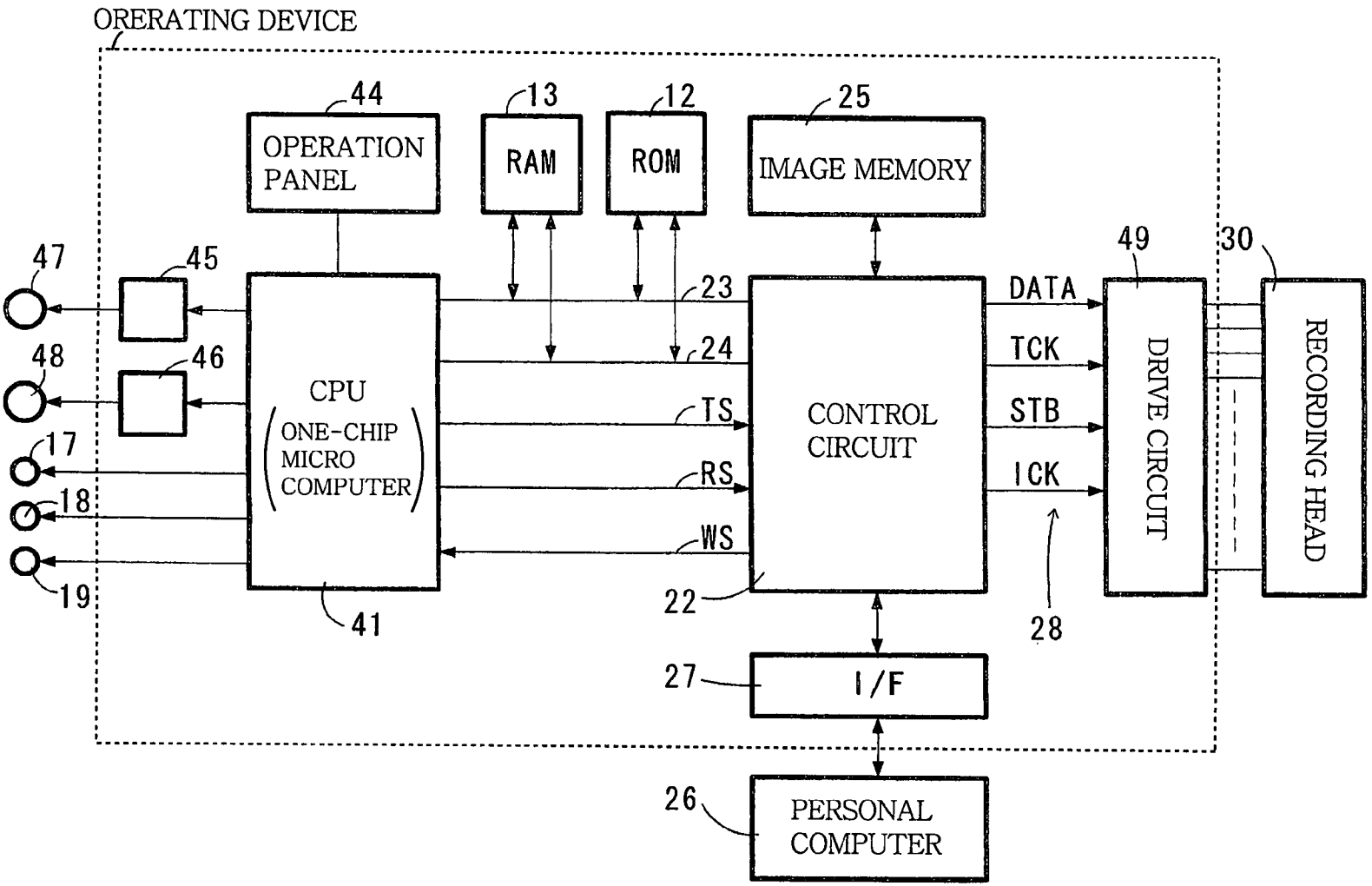
FIG. 3 is a block diagram showing an electrical operation system of the inkjet printer.

Next, there will be described an electrical operation system of the inkjet printer 1 in the present embodiment by reference to FIGS. 3 and 4. FIG. 3 is a block diagram showing the electrical operation system of the inkjet printer 1. As shown in FIG. 3, the system has an operating device which includes: a CPU 41, i.e., one-chip micro computer, which controls various elements of the inkjet printer 1; a control circuit 22 which is provided by a gate circuit LSI; a ROM 12 which stores operation programs and drive waveform data for ejecting the four color inks; and a RAM 13 which temporarily stores various data. The operating device further includes the above-indicated drive circuit 49. The operating device performs various operations by executing the operation programs stored in the ROM 12.

The CPU 41 is connected to: an operation panel 44 through which various commands are inputted; a motor driver 45 which drives a carriage motor 47 for reciprocating the head holder 9; a motor driver 46 which drives a feed motor 48 for driving the feed device; a recording medium sensor 17 for detecting presence or absence of the recording sheets P; a home position sensor 18 for detecting the recording head 30 being positioned at a home position; and an ink cartridge installation sensor 19 for detecting condition in which the ink cartridges 5 are attached correctly.

The CPU 41, the ROM 12, the RAM 13 and the control circuit 22 are connected to each other via an address bus 23 and a data bus 24. The CPU 41 generates, according to the programs stored in the ROM 12, a record-timing signal TS and a control signal RS, and transfers both of the signals TS, RS to the control circuit 22. The control circuit 22 controls an image memory 25 to store recording operation data which is transferred from an external apparatus such as a personal computer 26, via an interface 27. Then, the control circuit 22 generates an interruption signal WS based on the data transferred from the personal computer 26, etc., and transfers the interruption signal WS to the CPU 41. Further, the control circuit 22 generates, in accordance with the record-timing signal TS and the control signal RS, based on the above-described recording operation data stored in the image memory 25, a recording operation data signal DATA for actualizing the image on the recording sheet P based on the recording operation data, a transfer-clock signal TCK synchronized with the recording operation data signal DATA, a strobe signal STB, and a drive waveform signal ICK. The generated signals DATA, TCK, STB, ICK are transferred to the drive circuit 49.

Figure 4:
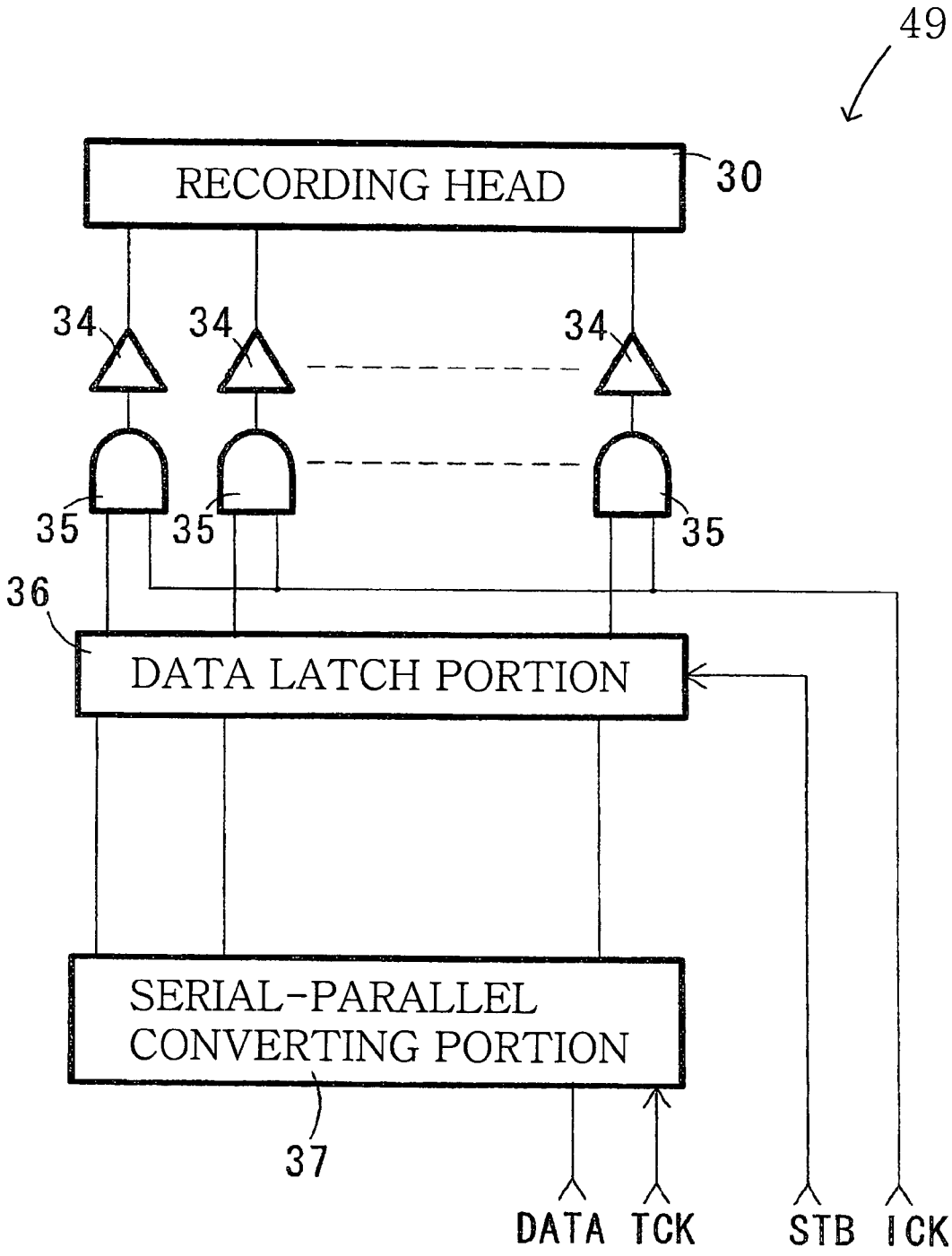
FIG. 4 is a block diagram showing an inner construction of a drive circuit of the inkjet printer.

FIG. 4 is a block diagram showing an inner construction of the drive circuit 49. The drive circuit 49 includes: (a) a serial-parallel converting portion 37 which converts, to a parallel data signal, the recording operation data signal DATA as a serial data signal that is transferred from a data transferring portion (not shown) in the control circuit 22 in synchronism with the transfer-clock signal TCK; (b) a data latch portion 36 which latches, based on the strobe signal STB, the converted recording operation data signal DATA as the parallel data signal; (c) a plurality of AND gates 35 each of which selectively outputs, based on the recording operation data signal DATA as the parallel data signal, a drive waveform signal ICK; and (d) a plurality of output portions 34 each outputting a drive pulse signal in which voltage of the drive waveform signal ICK outputted from a corresponding one of the AND gates is adjusted moderately for the actuator 31. The outputted drive pulse signal includes a plurality of drive pulses each of which is applied between the common electrodes 32 and the individual electrodes 33 for deforming the active portions of the actuator 31. The number of AND gates 35 and the number of output portions 34 correspond to the number of nozzles 15 of the recording head 30.

In the present embodiment, the drive pulse signal, i.e., the drive waveform signal ICK, for restoring the ink-droplet ejection performance of the recording head 30 includes: (a) a plurality of first pulse-trains 50A each of which includes at least one ejection drive pulse each for ejecting the ink droplet independently of the recording operation data (FIG. 5B); and (b) a plurality of second pulse-trains 50B each of which includes at least one non-ejection drive pulse each for giving moderate vibration to the meniscus of the ink formed in the nozzle 15 with no ink ejection (FIG. 5B). Data of both of the pulse-trains 50A, 50B are stored in the ROM 12 selectively read by execution of the specific operation program.

In detail, as shown in FIG. 5B, the first pulse-train 50A includes three ejection drive pulses 50*a*, 50*b*, 50*c* and one non-ejection drive pulse 50*d*. Further, the first pulse-train 50A has a first period Ta which is identical with a period of a pulse-train for forming one dot of the ink on the recording sheet P in the recording operation. A frequency of the first pulse-train 50A is 26 kHz and the voltage of the ejection pulses 50*a*, 50*b*, 50*c* after being adjusted by the output portion 34 is 22 V. When the active portion of the actuator 31 is deformed by rising and falling of a drive pulse, a pressure wave is generated in the ink accommodated in the pressure chamber 16. A unit time "AL" is defined as a half time of a fluctuation period of the pressure wave, namely, a time in which the pressure wave is transmitted in one-way in an ink channel of the recording head 30 including the pressure chamber 16. As explained by using the unit time "AL", a width of each of the three ejection drive pulses 50*a*, 50*b*, 50*c* is about 1 AL and a time length of each of intervals interposed between any successive two of the ejection drive pulses 50*a* and 50*b*, 50*b* and 50*c* is also about 1 AL. Therefore, the voltage applied to the actuator 31 reaches the highest voltage predetermined with respect to the drive pulse, i.e., 22 V. Accordingly, three droplets of the ink are efficiently ejected from each nozzle 15. A total volume of the three droplets of the ink ejected from one nozzle 15 is about 24 pl. Subsequently, at a moderate timing, the non-ejection drive pulse 50*d* is applied so as to set off the remaining pressure wave in the ink which is generated by the three ejection drive pulses 50*a*, 50*b*, 50*c*.

Figure 5A:
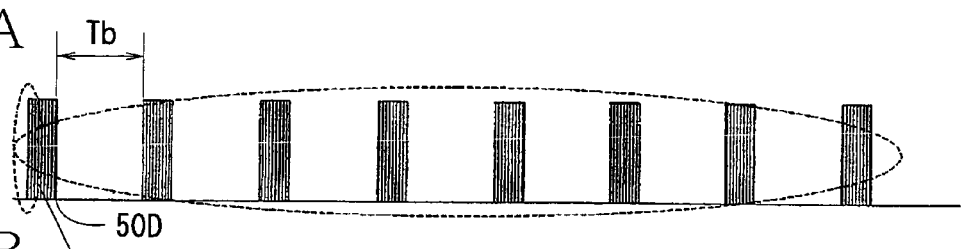
FIG. 5A is a view showing a waveform of the conventional drive pulse signal including a plurality of pulse groups.
Figure 5B:
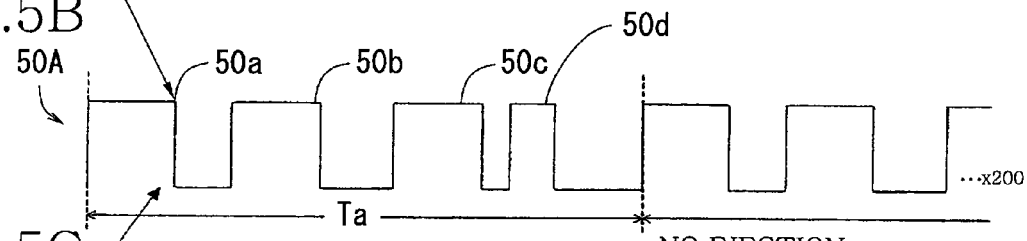
FIG. 5B is a view of a waveform of a first pulse-train which has ejection drive pulses.
Figure 5C:
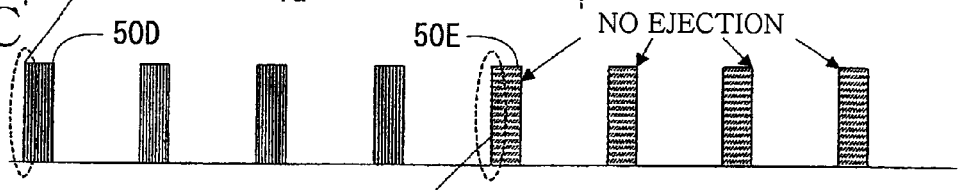
FIG. 5C is a view of a waveform of a drive pulse signal employed in the present embodiment, the signal including a plurality of pulse groups.
Figure 5D:
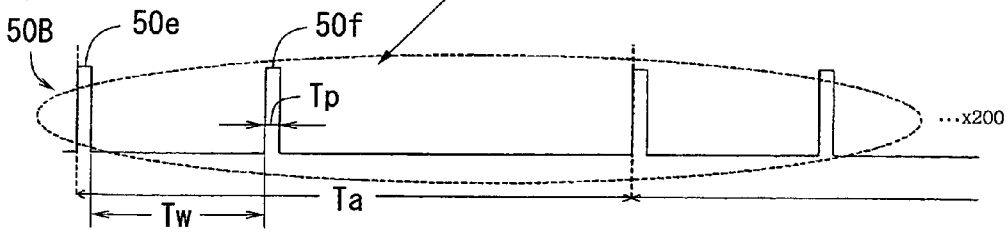
FIG. 5D is a view of a waveform of a second pulse-train which has non-ejection drive pulses.

As shown in FIG. 5D, the second pulse-train 50B has a second period Ta and includes two non-ejection drive pulses 50*e*, 50*f*. A width of each of the two non-ejection drive pulses 50*e*, 50*f* is set to "Tp" and a time length of an interval interposed between the two non-ejection drive pulses 50*e*, 50*f* is set to "Tw". As described in detail later, preferable ranges of "Tp" and "Tw" expressed using the above-described unit time, i.e., "AL", are 0.1-0.35 AL and 0.1-4.5 AL, respectively. A time length defined by "AL" may be changed due to a various factors such as an inherent vibration frequency of the ink, a length of the ink channel in the cavity unit 20, a resistance to a flow of the ink in the ink channel, rigidity of plates which define the ink channel. It is noted that 1 AL is 4.5 μsec in the present embodiment.

The actuator 31 functions as a capacitor in which the common electrodes 32 and the individual electrodes 33 are sandwiched between any two of the piezoelectric ceramics layers 31*a*. Therefore, where the non-ejection drive pulse 50*e*, 50*f* having the width "Tp" is employed, the pulse falls before the voltage applied to the active portion of the actuator 31 reaches the predetermined highest voltage. Consequently, moderate pressure acts on the ink in the pressure chambers 16 such that the ink is not ejected from the nozzles 15 and such that vibration is given to the meniscus of the ink formed in the nozzles 15. Accordingly, the ink in the nozzles 15 is stirred with no ink ejection, thereby preventing the ink in the nozzles 15 from being dried.

Next, there will be described drive pulse signals which include the drive pulses and which are outputted to the actuator 31 in the restoring operation for restoring the ink-droplet ejection performance of the recording head 30, by reference to FIGS. 5A, 5B, 5C, and 5D.

FIG. 5A is a view of a waveform of a conventional drive pulse signal including a plurality of pulse groups. According to the conventional drive pulse signal, a first pulse group 50D is successively outputted for all of the nozzles 15 eight times with first intervals Tb each of which is longer than the first period Ta. In the first pulse group 50D, the first pulse-train 50A which includes the three ejection drive pulses 50*a*, 50*b*, 50*c* and one non-ejection drive pulse 50*d* and which is outputted at the first period Ta is repeated 200 times. By the conventional drive pulse signal, the ejection of the ink whose volume is 200×24 pl is repeated eight times, thereby conventionally restoring the ink-droplet ejection performance.

Meanwhile, in the present embodiment, a drive pulse signal generated in the flushing operation is a combination of the first pulse-trains 50A and the second pulse-trains 50B. More specifically, the flushing operation includes: (a) a first operation for outputting the plurality of first pulse groups 50D each of which includes the first pulse-trains 60A; and (b) a second operation for outputting a plurality of second pulse groups 50E each of which includes the second pulse-trains 50B. In the drive pulse signal of the present embodiment, the first pulse-train 50A is successively outputted 200 times for all nozzles 15 in each of the first pulse groups 50D. Thereafter, the second pulse-train 50B is successively outputted 200 times for all nozzles 15 in each of second pulse groups 50E.

Initially, the first operation is performed in the following manner. As shown in FIG. 5C, the first pulse group 50D is successively outputted at four times with the first intervals Tb each as an intermission. Each of the first intervals Tb has a length of about 300 msec which corresponds to a total time length of about 7,800 first periods Ta. That is, in the first operation, the plurality of first pulse groups 50D each including the plurality of the first pulse-trains 50A by which the ink can be ejected independently of the recording operation are outputted to the actuator 31, whereby the ink is ejected from the nozzles 15.

Subsequently, the second operation is performed in the following manner. The second pulse group 50E is successively outputted at four times with a plurality of second intervals Tb each as an intermission. Each of the second intervals Tb has the same length as each of the above-described first intervals Tb, i.e., 300 msec. That is, in the second operation which is performed following the first operation, the plurality of second pulse groups 50E each including the plurality of the second pulse-trains 50B by which the ink can not be ejected onto the recording sheet P are outputted to the actuator 31, whereby moderate vibration is given to the ink in the nozzles 15 without ink-droplet ejection.

It is possible to easily perform the first and second operations since both of the first interval in the first operation and the second interval in the second operation have the same length with each other and both of the first pulse group 50D in the first operation and the second pulse group 50E in the second operation are successively outputted at the same number of times, i.e., four times, even though the first operation and the second operation are different from each other in substances thereof such as drive pulses 50*a*-50*c*, 50*e*, 50*f*, pulse-trains 50A, 50B, and so on.

As described above, periodic vibration is given to the ink in the nozzles 15 by the first pulse-trains 50A and the second pulse-trains 50B. Further, the periodic vibration with different patterns is given to the ink in the nozzles 15 by the first pulse group 50D and the second pulse group 50E with the first and second intervals Tb longer than the first and second periods Ta, respectively. Therefore, vibration is given in complicated variation to the ink, whereby the ink in the nozzles 15 is effectively stirred. In consequence, it is possible to effectively prevent the ink in the nozzles 15 from thicking.

If two-hundred nozzles 15 are provided in the recording head 30, the ink-droplet ejection performance can be restored conventionally by ink-droplet ejection in which the ink whose volume is 200×24 pl is ejected eight times (see FIG. 5A). However, in the present droplet ejection apparatus, the ink-droplet ejection performance can be restored by ink-droplet ejection in which the ink whose volume is 200×24 pl is ejected four times. That is, a consumption amount of the ink in the flushing operation in the present droplet ejection apparatus can be reduced to a half of a consumption amount of the ink in the conventional flushing operation. Therefore, it is possible to greatly reduce the consumption amount of the ink per one flushing operation in the present droplet ejection apparatus.

In the conventional drive pulse signal, since each of the first pulse-trains 50A which constitute one of the first pulse groups 50D includes the above-indicated three ejection drive pulses 50*a*, 50*b*, 50*c* and one non-ejection drive pulse 50*d*, 4×200 drive pulses in one of the first pulse groups 50D need to be outputted eight times in the restoring operation. However, in the present embodiment, the first pulse group 50D is initially outputted four times, and subsequently the second pulse group 50E by which vibration is given to the ink without the ink ejection and which includes the two non-ejection drive pulses 50*e*, 50*f* each to be repeated 200 times is outputted four times. Accordingly, a number of the ejection drive pulses to be outputted is decreased, whereby a number of driving of the actuator 31 is decreased as well. Therefore, the present embodiment is effective to save an electric power and reduce heating of the actuator 31.

Further, the first operation by which the ink can be ejected is performed first and the second operation by which vibration is given to the ink in the nozzles 15 without the ink ejection is performed following the first operation, whereby the remaining vibration in the ink due to the ink ejection caused by the first operation can be suppressed by the second operation. Accordingly, the quality of the recording is not deteriorated even if the recording operation is performed immediately after the flushing operation. Therefore, it is possible to shorten a total time of the recording process.

Next, there will be described the second pulse-train 50B based on a result of an examination in which various combinations of "Tp" and "Tw" are examined in order to find an optimized combination of "Tp" and "Tw" such that moderate vibration is given to the ink contained in the nozzles 15 without the ink ejection. The result of the examination is shown in FIG. 6.

As shown in FIG. 6, a plurality of time values ranging from 0.13 AL to 0.31 AL are assigned to "Tp", and a plurality of time values ranging from 0.11 AL to 4.44 AL are assigned to "Tw". Each one of the time values of "Tp" is in combination with each one of the time values of "Tw", such that various combinations of "Tp" and "Tw," are applied to the second pulse-train 50B which is to be outputted. Respective three degrees of environmental temperature, i.e., 14° C., 24° C., and 34° C., is applied to the examination since a speed of the drying of the ink in each of the nozzles 15 of the recording head 30 is influenced by the environmental temperature. At every one of 14° C., 24° C. and 34° C., whether the ink is ejected or not is observed. The result of the examination shown in FIG. 6 includes four evaluations as follows: (a) "○" is given when the ink is not ejected at all environmental temperatures of 14° C., 24° C., and 34° C.; (b) "Δ" is given when the ink is ejected at not less than 34° C.; (c) "▲" is given when the ink is ejected at not less than 24° C.; and (d) "X" is given when the ink is ejected at all environmental temperatures of 14° C., 24° C., and 34° C. It is noted that a few errors in the values given in the examination shown in FIG. 6 are allowable since almost the same result as that of the examination shown in the FIG. 6 is attained even if there are a few errors in the values. For example, results of the examination when the value of "Tp" =0.13 AL shown in FIG. 6 may be almost the same as results of the examination when the value of "Tp" has a range of 0.1 AL Tp 0.15 AL.

As shown in FIG. 6, one time value in 0.1 AL Tp 0.35 AL is in combination with one time value in 0.1 AL Tw 4.5 AL. Based on the above-described combination of Tp and Tw, the second pulse-train 50B is outputted. In this arrangement, the examination results in "X", namely, the ink is ejected when any one of the combinations of time range of "Tp" and "Tw" selected from the following is applied: (i) 0.2 AL Tp 0.35 AL, 0.1 AL Tw 0.2 AL; and (ii) 0.25 AL Tp 0.35 AL, 0.2 AL Tw 0.4 AL.

Meanwhile, the examination results in "○", namely, the ink is not ejected when any one of the combinations of time range of "Tp" and "Tw" selected from the following is applied (iii) 0.1 AL Tp 0.2 AL, 0.2 AL Tw 4.5 AL; (iv) 0.1 AL Tp 0.15 AL, 0.1 AL Tw 4.5 AL; (v) 0.1 AL Tp 0.35 AL, 0.4 AL Tw 1.0 AL; (vi) 0.1 AL Tp 0.3 AL, 0.4 AL Tw 1.5 AL; (vii) 0.1 AL Tp 0.3 AL, 2.5 AL Tw 3.5 AL; (viii) 0.1 AL Tp 0.3 AL, 4.2 AL Tw 4.5 AL; and (ix) 0.1 AL Tp 0.25 AL, 2.5 AL Tw 4.5 AL. Therefore, the ink is not ejected at any environmental temperature if any one of the combinations of the time range of "Tp" and "Tw " selected from (iii) through (ix) as indicated above is applied.

In particular, "◎" is given in the results shown in FIG. 6 when the ink is not ejected at all environmental temperatures of 14° C., 24° C., and 34° C. in optimum conditions in which the second pulse-train 50B that has adequate energy for giving vibration to the meniscus formed in the ink in each of the nozzles 15 and stirring new ink into the thickened ink is applied. According to the results of the examination shown in FIG. 6, it is preferable to apply the second pulse-train 50B in which any one of the combinations of time range of "Tp" and "Tw" selected from the following is applied; (x) 0.15 AL Tp 0.2 AL, 2.0 AL Tw 3.5 AL; and (xi) 0.15 AL Tp 0.25 AL, 2.5 AL Tw 3.0 AL. Specifically, it is preferable that the time value of "Tp" ranges from 0.7 μsec to 1.1 μsec and that the time value of "Tw" is about 12 μsec, where the time value of "AL" is 4.5 μsec.

It is to be understood that the present invention may be embodied with other changes and modifications that may occur to a person skilled in the art, without departing from the spirit and scope of the invention defined in the appended claims.

For example, in the above-described embodiment, the droplet ejection apparatus is realized in the inkjet printer. However, the droplet ejection apparatus according to the present invention can be realized in other apparatus which ejects a plurality of tiny droplets of various colored liquid.

Further, in the above-described embodiment, the first pulse-train 50A includes four pulses 50*a*, 50*b*, 50*c*, 50*d* in the first drive pulse period Ta. However, the present invention is not limited to the above-described embodiment. It is possible to apply other types of drive pulse-train by which the ink can be ejected. Moreover, the present invention is not limited to an arrangement in which the ejection drive pulse 50*a*, 50*b*, 50*c* to be outputted in the first operation in the restoring operation for restoring the ink-droplet ejection performance of the recording head 30 is identical with the drive pulse to be outputted by the operating device in the recording operation. It is possible to determine the ejection drive pulse such that an amount of the droplet to be ejected by the ejection drive pulse is larger than an amount of the droplet to be ejected in the recording operation, whereby the restoring operation can be performed powerfully. In this arrangement, even though an amount of the ink ejected is large in the first operation, vibration given to the meniscus of the ink formed in the nozzles by the first operation is gradually suppressed by the second operation. Therefore, the recording performance in the next recording operation is not deteriorated.

The present invention is not limited to an arrangement in which the first pulse-train 50A is outputted at the first period Ta that has the same time length as the second period Ta of the second pulse-train 50B. For example, either one of the first pulse-train or the second pulse-train may be a long pulse-train which is outputted at over two drive periods, as disclosed in JP-A-2002-160362.

The present invention is not limited to an arrangement in which both of the first and second operations are performed when the recording head 30 is located at the flushing position in the non-recording area at which the lower surface of the recording head 30 faces the upper surface of the droplet receiver 4. It is possible that the first operation is performed at the flushing position and the second operation is performed while the recording head 30 is moved back from the flushing position to the recording area since the ink is not ejected in the second operation. Accordingly, a total time in which the recording head 30 is stopped at the flushing position can be shortened, that is, a total time of the recording process can be shortened.

The present invention is not limited to an arrangement in which the first interval Tb in the first pulse group 50D has the same length as the second interval Tb in the second pulse group 50E. The second interval of the second pulse group may be shorter than the first interval of the first pulse group because mischief does not occur in the second operation. Accordingly, it is possible to shorten the recording process. Further, the present invention is not limited to an arrangement in which a number of the plurality of the first pulse groups 50D to be outputted in the first operation is the same as a number of the plurality of the second pulse groups 50E to be outputted in the second operation. It is possible that the number of the plurality of the first pulse groups 50D is different from the number of the plurality of the second pulse groups 50E according to arbitrary purposes.

The present invention is not limited to an arrangement in which voltage is applied to the actuator 31 by the pulse-train 50B within each of the pulse width Tp of the non-ejection drive pulses 50*e*, 50*f*. It is also possible to embody the present invention with another arrangement in a following manner. Voltage is applied to the actuator 31 in a normal state such that volume of the pressure chamber 16 is reduced, then the volume of the pressure chamber 16 is increased due to stoppage of applying voltage to the actuator 30 within the pulse width of the non-ejection drive pulses. Consequently, the volume of the pressure chamber 16 is reduced within the interval between the non-ejection drive pulses. The above-described manner may be repeated for a plurality of times.

What is claimed is:

1. A droplet ejection apparatus used for a recording operation in which a droplet of a liquid is ejected on a recording medium, comprising:

a recording head including (a) a nozzle from which the droplet of the liquid is ejected, (b) a pressure chamber which is filled with the liquid and whose volume is changeable for ejecting the droplet from the nozzle, and (c) an actuator which changes the volume of the pressure chamber by a drive pulse inputted thereto;

a carriage which holds the recording head and which is capable of reciprocating the recording head; and an operating device which outputs the drive pulse to the actuator and which controls the carriage such that the recording head is reciprocated over a recording area where the recording operation is performed and a non-recording area which is outside of the recording area;

wherein the operating device is capable of performing a restoring operation for restoring a droplet ejection performance of the recording head, the restoring operation including:

a first operation for outputting, a plurality of times, an ejection drive pulse as the drive pulse by which the droplet can be ejected; and a second operation for outputting, a plurality of times, a non-ejection drive pulse as the drive pulse by which the droplet can not be ejected and by which vibration can be applied to a meniscus of the liquid which is formed in the nozzle, the second operation being performed following the first operation;

wherein the first operation is for outputting a plurality of first pulse groups in each of which a first pulse-train having at least one pulse each as the ejection drive pulse is repeated continuously at a first period, and which are outputted such that a first interval longer than the first period is interposed between any successive two of the plurality of first pulse groups;

wherein the second operation is for outputting a plurality of second pulse groups in each of which a second pulse-train having at least one pulse each as the non-ejection drive pulse is repeated continuously at a second period, and which are outputted such that a second interval longer than the second period is interposed between any successive two of the plurality of second pulse groups; and wherein the operating device is arranged to perform (a) the first operation when the recording head is located at a specific position in the non-recording area and (b) the second operation when the recording head is located at the specific position in the non-recording area or while the recording head is moved from the specific position to the recording area.

2. The droplet ejection apparatus according claim 1;

wherein the restoring operation is performed independently of the recording operation.

3. The droplet ejection apparatus according claim 1;

wherein the first period has the same length as the second period.

4. The droplet ejection apparatus according claim 1;

wherein a number of the plurality of first pulse groups is equal to a number of the plurality of second pulse groups.

5. The droplet ejection apparatus according claim 1;

wherein a number of repetition of the first pulse-train in each of the plurality of first pulse groups is equal to a number of repetition of the second pulse-train in each of the plurality of second pulse groups.

6. The droplet ejection apparatus according claim 1;

wherein a number of said at least one pulse each as the non-ejection drive pulse in the second pulse-train is smaller than a number of said at least one pulse each as the ejection drive pulse in the first pulse-train.

7. The droplet ejection apparatus according claim 1;

wherein the first interval is longer than a time length in which each of the plurality of first pulse groups is outputted and the second interval is longer than a time length in which each of the plurality of second pulse groups is outputted.

8. The droplet ejection apparatus according claim 1;

wherein the first interval has the same length as the second interval.

9. The droplet ejection apparatus according claim 1;

wherein the second interval is shorter than the first interval.

10. The droplet ejection apparatus according claim 1;

wherein a number of outputting of the non-ejection drive pulse in the second operation is smaller than a number of outputting of the ejection drive pulse in the first operation.

11. The droplet ejection apparatus according claim 1;

wherein the ejection drive pulse is identical with the drive pulse to be outputted by the operating device in the recording operation.

12. The droplet ejection apparatus according claim 1;

wherein the ejection drive pulse is determined such that an amount of the droplet to be ejected by the ejection drive pulse is larger than an amount of the droplet to be ejected in the recording operation.

13. The droplet ejection apparatus according to claim 1;

wherein the operating device is arranged to perform both of the first operation and the second operation when the recording head is located at a specific position in the non-recording area.

14. The droplet ejection apparatus according to claim 1;

wherein the operating device is arranged to perform (a) the first operation when the recording head is located at a specific position in the non-recording area and (b) the second operation while the recording head is moved from the specific position to the recording area.

* * * * *